US008669859B2

(12) United States Patent
Wang

(10) Patent No.: US 8,669,859 B2
(45) Date of Patent: Mar. 11, 2014

(54) SAFETY DETECTION ALARM DEVICE

(76) Inventor: Wen-Jaw Wang, Taipei (TW)

( * ) Notice: Subject to any disclaimer, the term of this patent is extended or adjusted under 35 U.S.C. 154(b) by 162 days.

(21) Appl. No.: 13/344,638

(22) Filed: Jan. 6, 2012

(65) Prior Publication Data

US 2013/0113617 A1 May 9, 2013

(30) Foreign Application Priority Data

Nov. 4, 2011 (TW) ..... 100220953 U

(51) Int. Cl.
*G08B 19/00* (2006.01)

(52) U.S. Cl.
USPC ..... 340/521; 340/693.5; 340/686.1

(58) Field of Classification Search
USPC ..... 340/521, 603, 501, 686.1, 686.6, 679, 340/685, 689, 564, 561, 506, 693.5, 693.9
See application file for complete search history.

(56) References Cited

U.S. PATENT DOCUMENTS

| | | | | |
|---|---|---|---|---|
| 4,010,822 | A * | 3/1977 | Banner | 182/18 |
| 6,507,473 | B2 * | 1/2003 | Richie et al. | 361/213 |
| 6,966,403 | B1 * | 11/2005 | Chandra | 182/18 |
| 8,156,686 | B1 * | 4/2012 | Zrodnikov | 47/58.1 SE |
| 2003/0020622 | A1 * | 1/2003 | Ching-Yao | 340/665 |
| 2003/0071180 | A1 * | 4/2003 | Soloway et al. | 248/217.3 |

* cited by examiner

*Primary Examiner* — Daniel Previl
(74) *Attorney, Agent, or Firm* — Ming Chow; Sinorica, LLC

(57) ABSTRACT

A safety detection alarm device for a ladder includes a control alarm unit and a sensor unit. A load sensor module, a voltage detection sensor module or an angle detection sensor module of the sensor unit is installed on the ladder. The load sensor module of the sensor unit is to detect the weight of the load. The voltage detection sensor module is to detect and sense the load of the electricity and current. The angle detection sensor module is to detect the angle of the ladder. A light alarm module or a sound alarm module is used to send an alarm to warn the user that the load, electricity or current of the ladder is over or the ladder is unstable. The present invention is safe for use and provides a better function for use.

1 Claim, 7 Drawing Sheets

SAFETY DETECTION ALARM DEVICE

BACKGROUND OF THE INVENTION

1. Field of the Invention

The present invention relates to a safety detection alarm device, and more particularly to a safety detection alarm device used for an industrial ladder.

2. Description of the Prior Art

Conventional ladders have various grades for different loads. The user must consider his/her weight and the weight of the articles that he/she carries to be within the range of the safe load. In general, the user only considers his/her weight and ignores the weight of the articles that he/she carries. Besides, the ladder is always used at a construction site or at the place where there are many exposed electric wires. Sometimes, the ladder may be contact with electric wires by accident. The conventional ladder has the following drawbacks.

1. Not safe for use: The ladder is unable to warn the user when the load is over or when the ladder is contact with electric wires by accident or the load of current is over, so it is not safe for use.

2. Not having additional functions: The ladder only provides a climb function, not having additional alarm functions.

Accordingly, the inventor of the present invention has devoted himself based on his many years of practical experiences to solve these problems.

SUMMARY OF THE INVENTION

The primary object of the present invention is to provide safety detection alarm device for a ladder to overcome the shortcomings of the conventional ladder.

In order to achieve the aforesaid object, the safety detection alarm device for a ladder comprises a control alarm unit and a sensor unit. The control alarm unit is electrically connected with the sensor unit. The control alarm unit comprises a processing device and an alarm device. The alarm device comprises a light alarm module and a sound alarm module. The processing device is electrically connected with the alarm device. A load sensor module, a voltage detection sensor module, or an angle detection sensor module of the sensor unit is installed on the ladder. The load sensor module of the sensor unit is to detect the weight of the load. The voltage detection sensor module is to detect and sense the load of the electricity and current. The angle detection sensor module is to detect the angle of the ladder. The light alarm module or the sound alarm module is used to send an alarm to warn the user that the load, electricity or current of the ladder is over or the ladder is unstable. The present invention is safe for use and provides a better function for use.

DETAILED DESCRIPTION OF THE PREFERRED EMBODIMENTS

Figure 1:
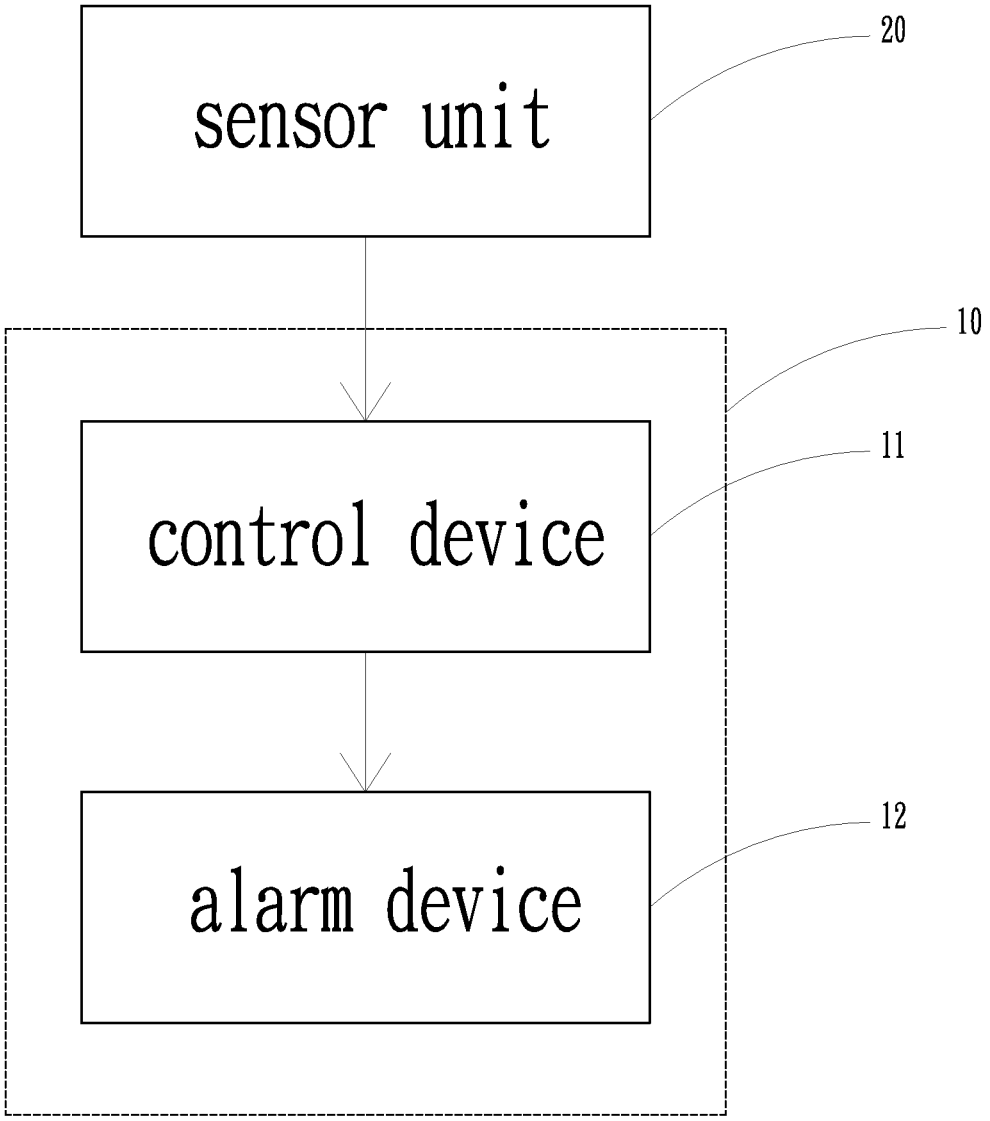
FIG. 1 is a diagram of the present invention.

Embodiments of the present invention will now be described, by way of example only, with reference to the accompanying drawings.

As shown in FIG. 1 through FIG. 4, the safety detection alarm device for a ladder according to a preferred embodiment of the present invention comprises a control alarm unit (10) and a sensor unit (20).

The control alarm unit (10) comprises a processing device (11) and an alarm device (12). The processing device (11) comprises a recognition unit (110), an indication unit (111), a memory unit (112), and a power supply unit (113). The alarm device (12) comprises a light alarm module (120) and a sound alarm module (121). The processing device (11) is electrically connected with the alarm device (12).

The sensor unit (20) is one of a load sensor module (21), a voltage detection sensor module (22), and an angle detection sensor module (23). The sensor unit (20) is electrically connected with the control alarm unit (10).

Figure 2:
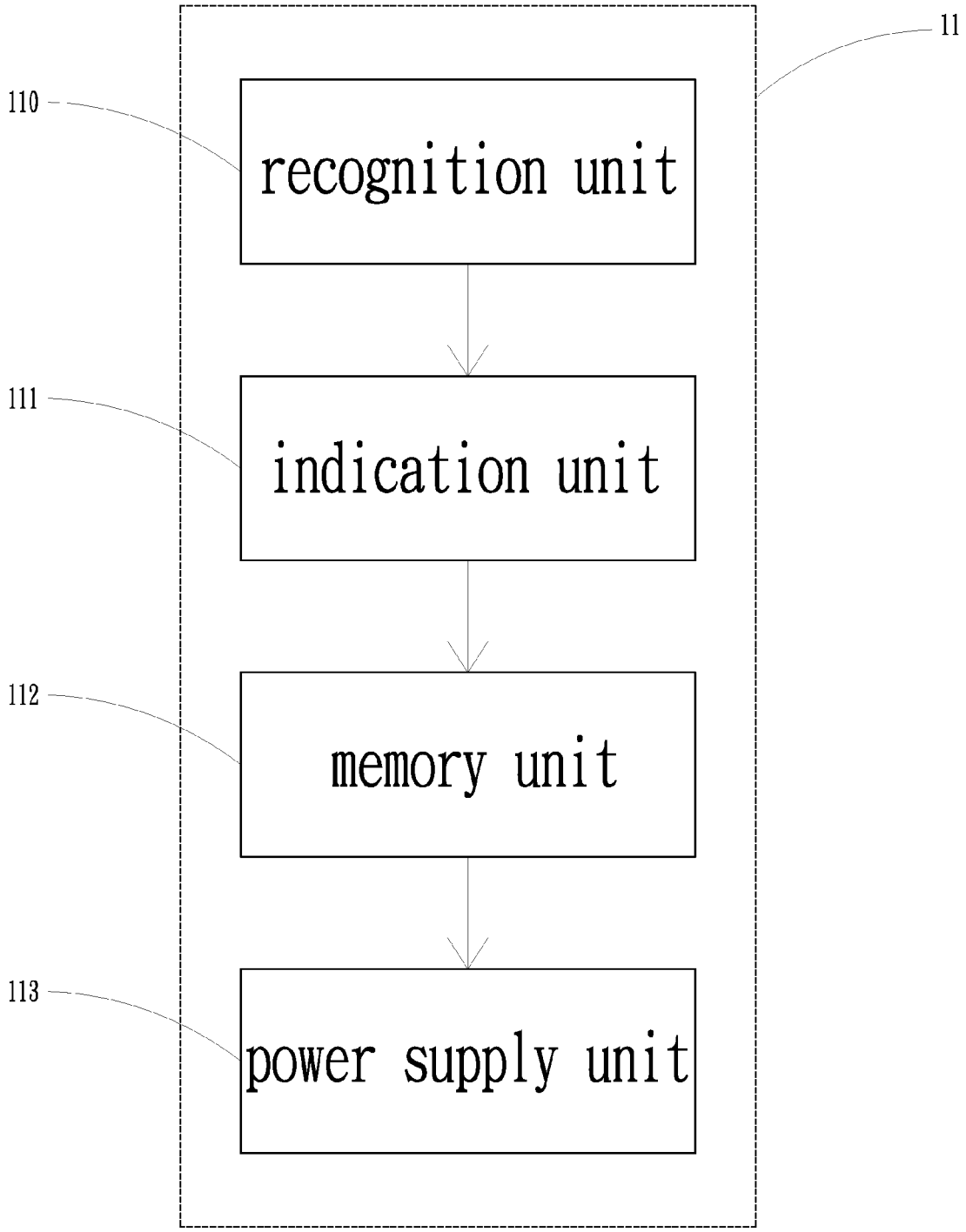
FIG. 2 is a diagram of the processing device of the present invention.
Figure 3:
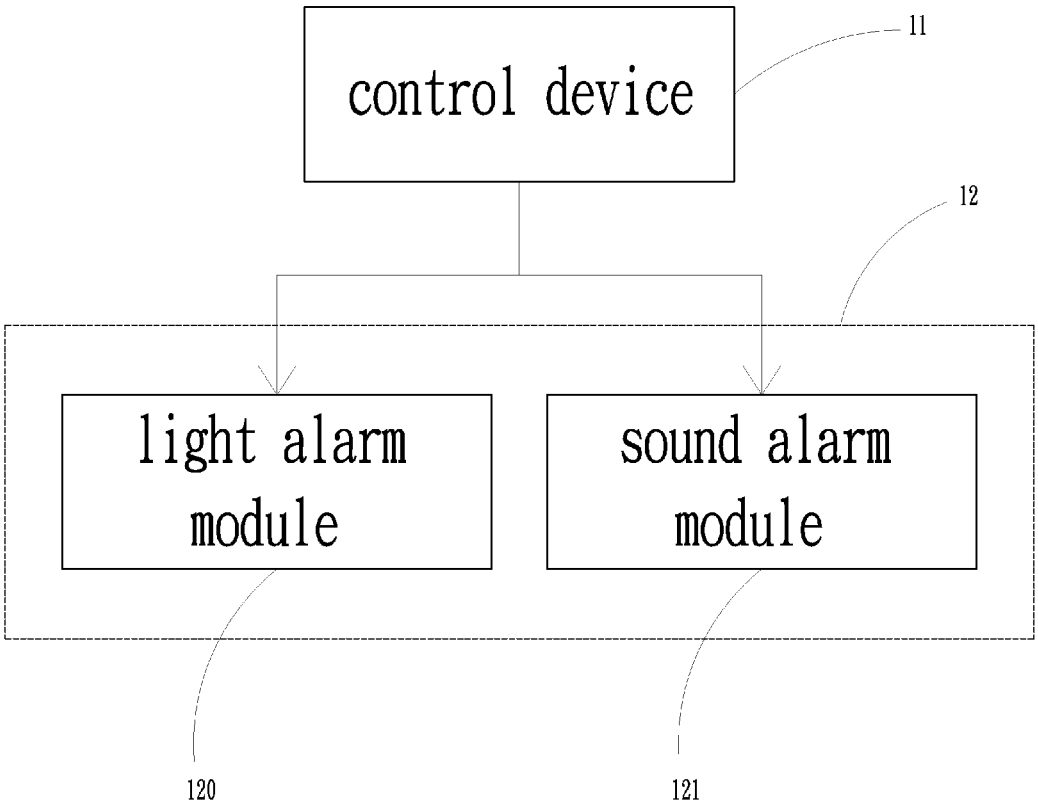
FIG. 3 is a diagram of the alarm device of the present invention.
Figure 4:
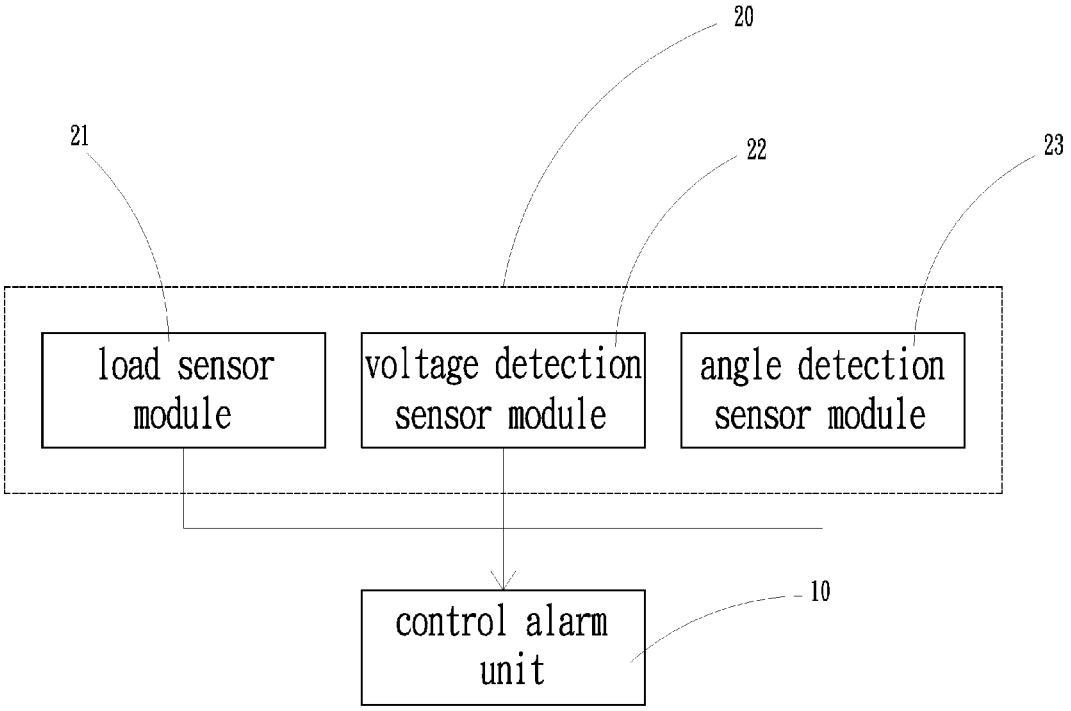
FIG. 4 is a diagram of the sensor unit of the present invention.
Figure 5:
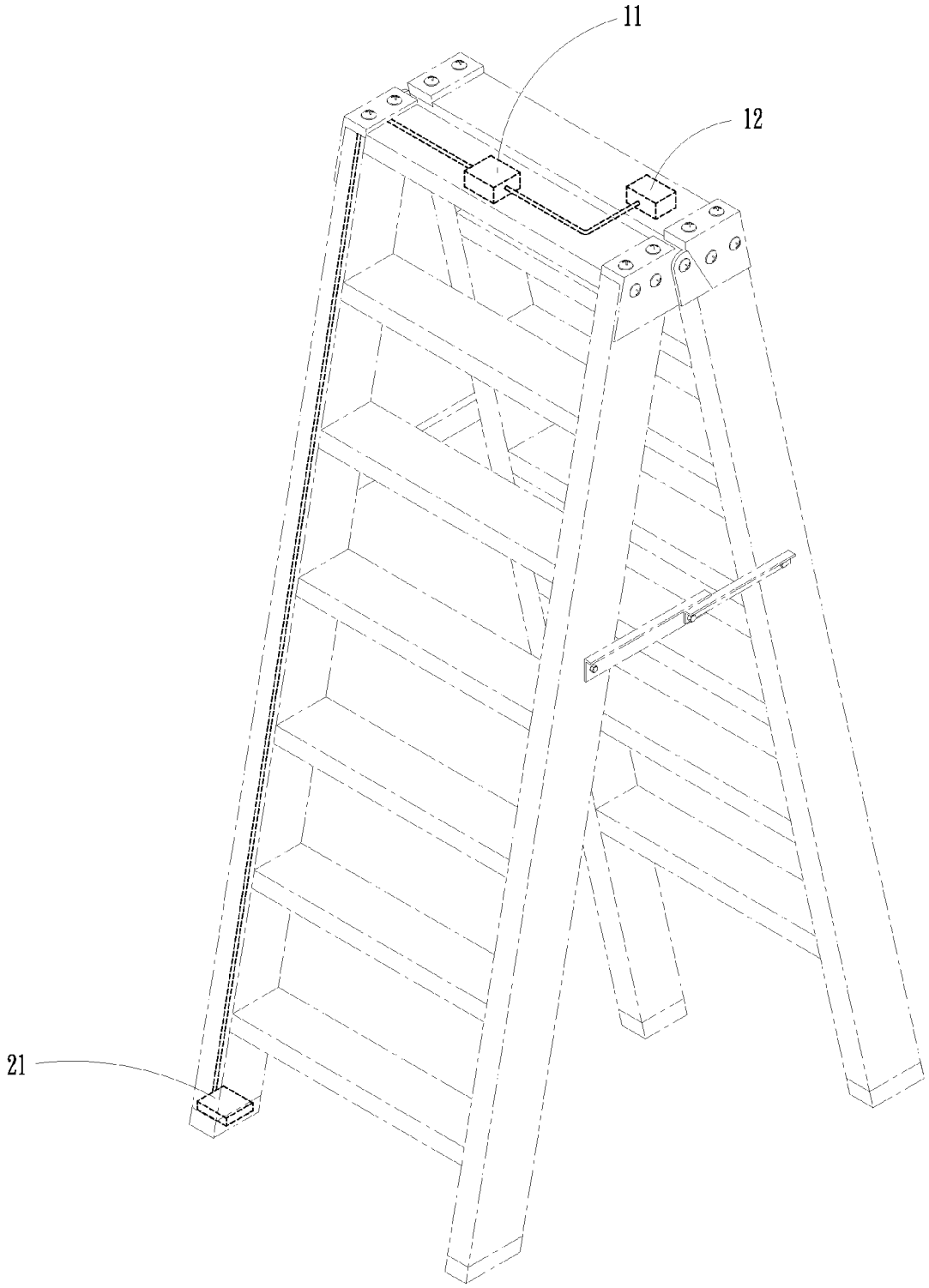
FIG. 5 is a schematic view showing the load sensor module of the present invention coupled to the ladder.
Figure 6:
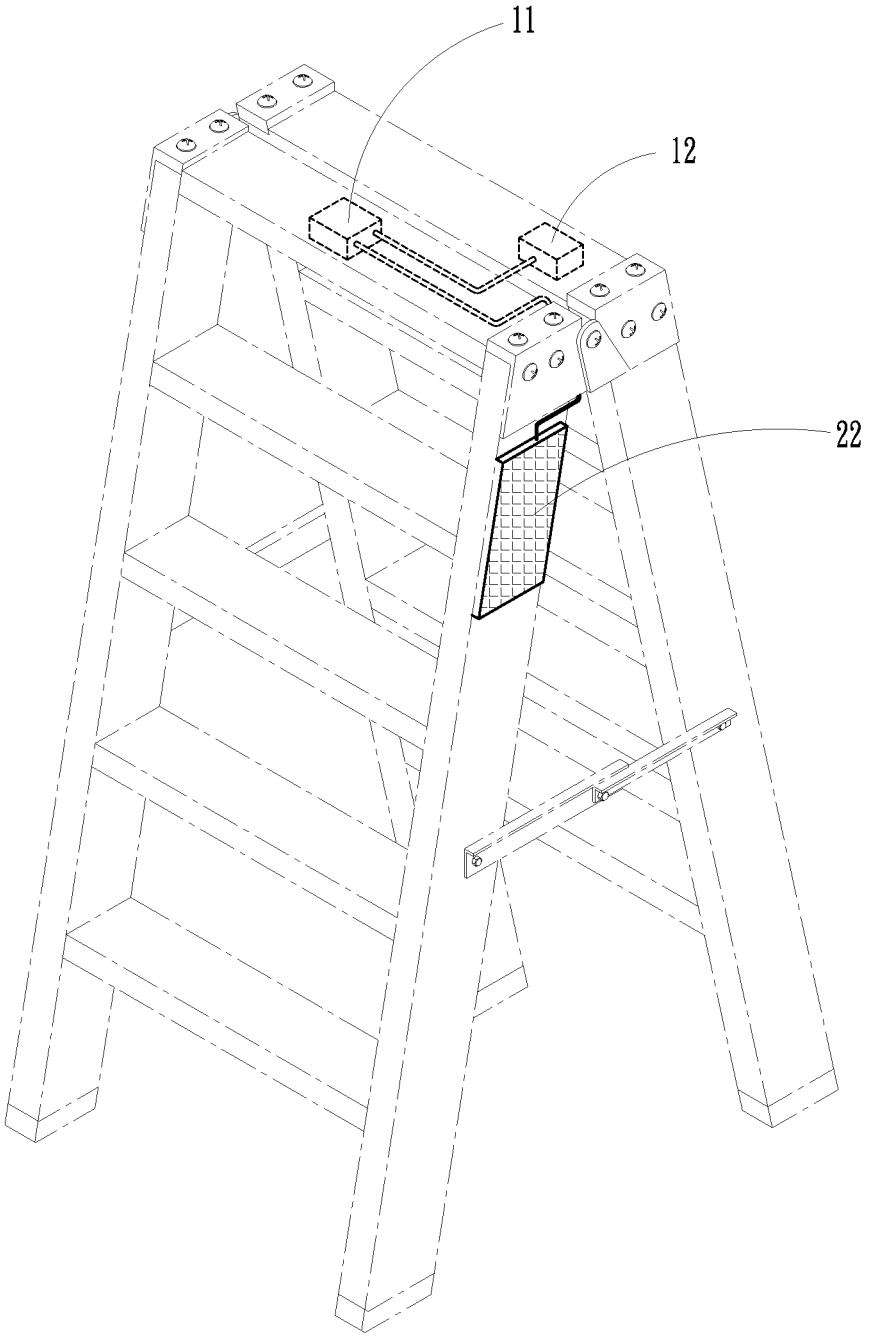
FIG. 6 is a schematic view showing the voltage detection sensor module of the present invention coupled to the ladder.
Figure 7:
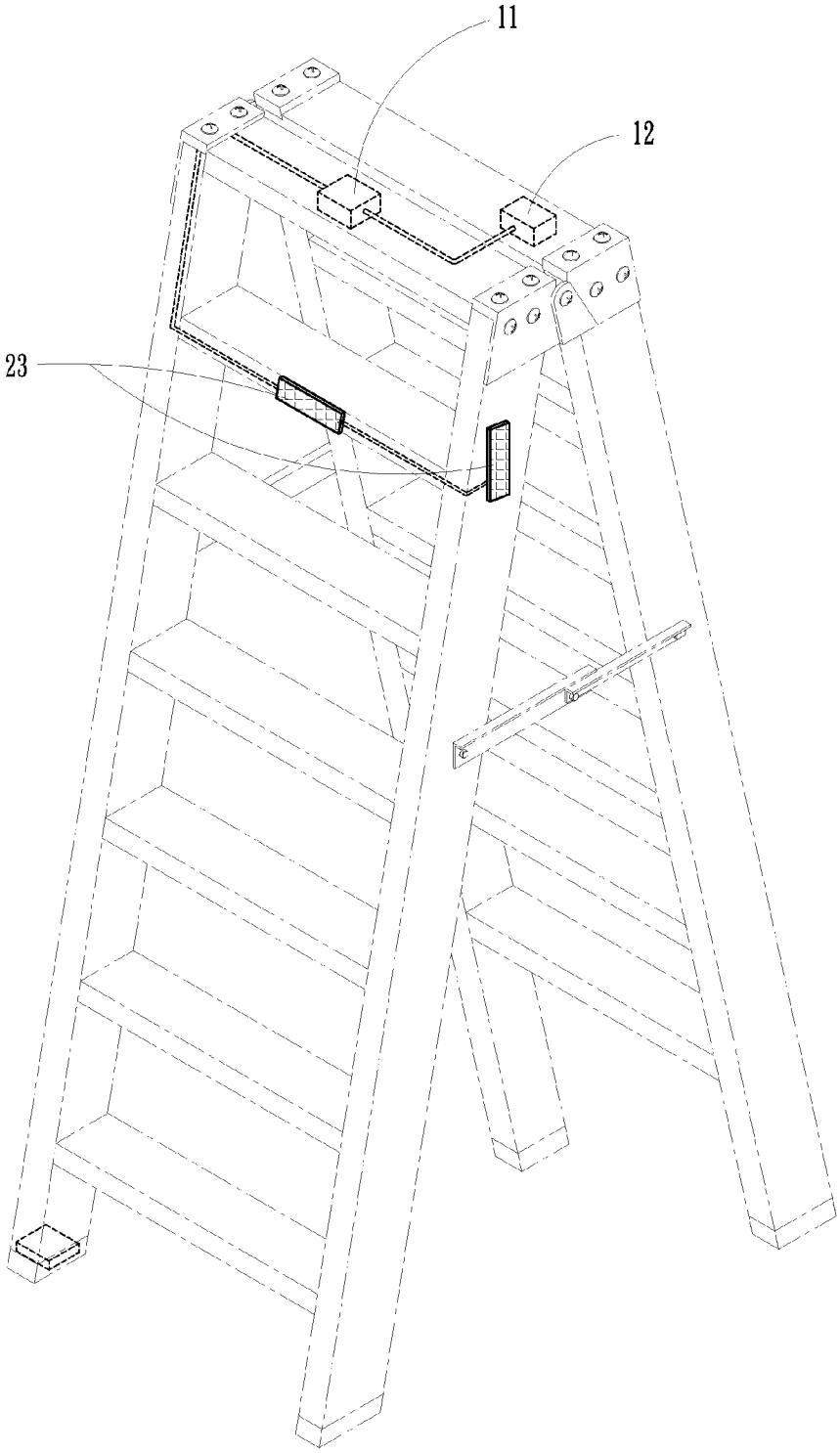
FIG. 7 is a schematic view showing the angle detection sensor module of the present invention coupled to the ladder.

Referring to FIG. 2 and FIG. 7, the light alarm module (120) is an LED strip. The sound alarm module (121) is a buzzer or a mini sounder. The sensor unit (20) is the load sensor module (21), the voltage detection sensor module (22), or the angle detection sensor module (23). The processing device (11) is electrically connected with the alarm device (12). The load sensor module (21), the voltage detection sensor module (22) or the angle detection sensor module (23) of the sensor unit (20) is installed on the ladder. The load sensor module (21) of the sensor unit (20) is to detect the weight of the load. The voltage detection sensor module (22) is to detect and sense the load of the electricity and current. The angle detection sensor module (23) is to detect the angle of the ladder. The light alarm module (120) or the sound alarm module (121) is used to send an alarm to warn the user that the load, electricity or the current of the ladder is over or the ladder is unstable. The present invention is safe for use and provides a better function for use.

The present invention has the following advantages.

1. Safe for use: The load sensor module or the voltage detection sensor module of the sensor unit is installed on the ladder. The load sensor module of the sensor unit is to detect the weight of the load. The voltage detection sensor module is to detect and sense the load of the electricity and current. The angle detection sensor module is to detect the angle of the ladder. The light alarm module or the sound alarm module is used to send an alarm to warn the user that the load, electricity or the current of the ladder is over or the ladder is unstable. The present invention is safe for use.

2. Better function for use: The load sensor module or the voltage detection sensor module of the sensor unit is installed on the ladder. The load sensor module of the sensor unit is to detect the weight of the load. The voltage detection sensor module is to detect and sense the load of the electricity and current. The angle detection sensor module is to detect the angle of the ladder. The light alarm module or the sound alarm module is used to send an alarm to warn the user that the load, electricity or the current of the ladder is over or the ladder is unstable. The present invention provides a better function for use to detect the current, load and the stability of the ladder.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A safety detection alarm device for a ladder, comprising:

a control alarm unit, the control alarm unit comprising a processing device and an alarm device, the processing device comprising a recognition unit, an indication unit, a memory unit and a power supply unit, the processing device being electrically connected with the alarm device, wherein the alarm device comprises a light alarm module and a sound alarm module, the light alarm module being an LED strip, and the sound alarm module being either a buzzer or a mini sounder; and a sensor unit, the sensor unit being one of a load sensor module, a voltage detection sensor module and an angle detection sensor module, the sensor unit being electrically connected with the control alarm unit.

* * * * *